US006137465A

United States Patent [19]

Sekine et al.

[11] Patent Number: 6,137,465

[45] Date of Patent: Oct. 24, 2000

[54] DRIVE CIRCUIT FOR A LCD DEVICE

[75] Inventors: Hiroyuki Sekine; Fujio Okumura, both of Tokyo, Japan

[73] Assignee: NEC Corporation, Tokyo, Japan

[21] Appl. No.: 09/195,617

[22] Filed: Nov. 19, 1998

[30] Foreign Application Priority Data

Nov. 19, 1997 [JP] Japan ..... 9-318233

[51] Int. Cl.[7] ..... G09G 3/36; G09G 5/00

[52] U.S. Cl. ..... 345/98; 345/204

[58] Field of Search ..... 345/92, 93, 94, 345/98, 99, 100, 204, 205, 206, 208

[56] References Cited

U.S. PATENT DOCUMENTS

| | | | |
|---|---|---|---|
| 4,651,149 | 3/1987 | Takeda et al. | 345/208 |
| 5,510,805 | 4/1996 | Lee | 345/100 |
| 5,526,014 | 6/1996 | Shiba et al. | 345/98 |
| 5,552,801 | 9/1996 | Furuhashi et al. | 345/100 |
| 5,623,279 | 4/1997 | Itakura et al. | 345/98 |
| 5,648,792 | 7/1997 | Sato et al. | 345/100 |
| 5,666,130 | 9/1997 | Williams et al. | 345/92 |
| 5,682,175 | 10/1997 | Kitamura | 345/98 |
| 5,721,563 | 2/1998 | Memida | 345/98 |
| 5,874,934 | 2/1999 | Ito | 345/98 |
| 5,900,853 | 5/1999 | Shimizu et al. | 345/100 |
| 6,025,835 | 2/2000 | Aoki et al. | 345/204 |
| 6,043,812 | 3/2000 | Utsunomiya et al. | 345/204 |

FOREIGN PATENT DOCUMENTS

| | | |
|---|---|---|
| 2-10436 | 3/1990 | Japan . |
| 2-209091 | 8/1990 | Japan . |

*Primary Examiner*—Steven J. Saras
*Assistant Examiner*—Paul A. Bell
*Attorney, Agent, or Firm*—Sughrue, Mion, Zinn, Macpeak & Seas, PLLC

[57] ABSTRACT

A drive circuit for a LCD device has a plurality of drive sections corresponding to a plurality of data lines in a pixel matrix. Each drive section receives a corresponding portion of a video signal to deliver the signal portion to a corresponding data line. The output circuit of each drive section includes an nMOS transistor, first switch, second switch and a pMOS transistor connected in series between power source lines to output the signal portion through the output node connecting the first switch and the second switch together. The nMOS transistor and pMOS transistor operate alternately for delivering a a positive signal and negative signal, respectively, thereby making it unnecessary to reset the data line for reducing power dissipation.

8 Claims, 5 Drawing Sheets

DRIVE CIRCUIT FOR A LCD DEVICE

BACKGROUND OF THE INVENTION (a) Field of the Invention

The present invention relates to a drive circuit for a LCD (liquid crystal display) device and, more particularly, to a drive circuit for an active matrix LCD device. The present invention also relates to a LCD device having such a drive circuit.

(b) Description of the Related Art

Recently, active matrix LCD devices having a TFT (thin film transistor) and a storage capacitor in each pixel element are increasingly used. FIG. 1 shows a general configuration of a conventional active matrix LCD in a block diagram.

The LCD device has a plurality of data lines 531 extending parallel to one another in a column direction, a plurality of gate lines 532 extending parallel to one another in a row direction, and a pixel matrix 53 including a plurality of pixel elements arranged in a matrix and each disposed in the vicinity of cross points of the data lines 531 and the gate lines 532.

Each pixel element includes therein a TFT 533 having a source connected to a corresponding data line 531 and a gate connected to a corresponding gate line 532, and a storage capacitor 534 connected between the drain of the TFT 533 and the ground. Each data line 531 and each gate line 532 are connected to a data driver 51 and a gate driver 52, respectively, of a LCD drive circuit disposed for the LCD panel. The data driver 51 receives a video signal Vsig in addition to a starting pulse SPd and a clock signal ϕd from a control circuit 50 to output portions of the video signal Vsig through respective data lines 531 during each horizontal scanning period, whereas the gate driver 52 receives a starting pulse SPg and a clock signal ϕg to select gate lines 532. The data driver 51 includes a scanning circuit, and a plurality of drive sections each disposed for a corresponding data line, each of the drive sections including a sample/hold circuit and an output circuit. The gate driver 52 includes a scanning circuit for consecutively selecting the gate lines 532 one by one during each vertical scanning period or frame period.

FIG. 2 shows a signal timing chart in the LCD device of FIG. 1. When the scanning circuit of the data driver 51 starts for scanning after receiving a starting pulse SPd from the control circuit 50, a video signal Vsig for a single horizontal line of the LCD panel supplied from the control circuit 50 is sampled in the data driver 51 in synchrony with a clock signal ϕd. That is, portions of the video signal Vsig for the single horizontal line are consecutively sampled and held by respective sample/hold circuits during the horizontal scanning period, and are output at the next horizontal scanning period through respective output circuits and data lines 531. The gate driver 52 starts for scanning after receiving a starting pulse SPg to select the gate lines 532 one by one during a vertical scanning period. By these operations, video signals are written into the pixel elements row by row, and stored by the respective storage capacitors to form a single frame in each frame period.

FIG. 3 shows an exemplified configuration of each drive section 51A of the data driver 51, whereas FIG. 4 shows a signal timing chart of the drive section of FIG. 3. The drive section of FIG. 3 is disposed for a single data line 531, and includes a sample/hold circuit 55 and an output circuit 56. The sample/hold circuit 55 includes switches 61 and 63 and first and second storage capacitors 62 and 64, and the output circuit 56 is implemented by a source follower.

The input node Vin of the drive section 51A is connected to the input terminal of the data driver 51, which in turn is connected to a video signal line. Switch 61 is closed by a scanning signal SMa supplied from the scanning circuit, to receive a portion of the video signal Vsig supplied at that time corresponding to the specific data line 531, thereby storing the signal portion on a first storage capacitor 62. After the scanning circuit scans one horizontal line during a single horizontal period, switch 63 together with other corresponding switches for other data lines is closed by a control signal SMb at the same time to shift the signal portion from the first storage capacitor 62 to a second storage capacitor 64, together with corresponding other signal portions of the video signal supplied during the horizontal period. The video signal portion stored on the second storage capacitor 64 is supplied to the data line 531 as an output video signal Vout during the next horizontal period together with other signal portions to form a single frame image.

In a LCD device, the video signal Vsig has a large amplitude of 5 to 12 volts, for example, and also it is required for the output circuit to effect a quick charge and quick discharge of the data line within tens of micro seconds. The load capacitance CL of the drive section 51A is a sum of the pixel capacitor 534 and the parasitic capacitance of the data line 531. The frequency characteristics of the output circuit are determined by a time constant, which is defined by the load capacitance and the on-resistance of the transistor 65 during a charge period of the data line and by the load capacitance and the load resistance 66 during a discharge period of the data line. Thus, in order for improvement of the frequency characteristics of the output circuit, it is desired to reduce the on-resistance of the transistor 65 and the load resistance 66.

However, if the load resistance 66 is to be reduced to obtain a sufficient frequency characteristics of the output circuit, there arises a problem in that a penetrating current increases which flows from the high potential source line VH to the low potential source line VL at any time through the transistor 65 and the load resistance 66. The penetrating current flowing even after completion of the charge and discharge of the data line involves a large power dissipation in the driver circuit 51 of the LCD device.

Especially in the case of a drive circuit disposed on a common glass substrate together with the pixel matrix, it is known that radiation through the glass substrate is extremely low to thereby cause a temperature rise in the drive circuit, raising a critical thermal problem therein.

There is a solution of the above problem in JP-B-2(1990)-10436. The proposed drive circuit, as shown in FIG. 5, includes a switch 68 in the output circuit in place of the load resistor 66 shown in FIG. 3, and additionally a switch 69 connected between the gate of the output transistor 65 and a low level voltage source VRL. Referring additionally to FIG. 6 showing a signal timing chart in the proposed drive circuit, before transferring a video signal portion from the first capacitors 62 to the second capacitors 64, switches 69 are closed by a control signal RSTg to set the gate voltage Vg of the output transistors 65 at a low level VRL, thereby turning off the transistors 65. During the period when the output transistors 65 are off, switches 68 are closed by control signal RSTd to discharge the data lines, thereby setting the output nodes Vout at a low level VL After switches 67 and 68 are opened by a low level of control signals RSTg and RSTd, the video signal is transferred from the first capacitors 62 to the second capacitors 64 by control signal SMb so that each output transistor 65 charges the load capacitor 67 to a voltage level corresponding to the gate voltage thereof. Here, each output voltage Vout is defined by the threshold voltage Vt and the gate voltage Vg of each output transistor 65 as follows:

$$Vout=Vg-Vt \quad (1)$$

After the load capacitor 67 is charged to the voltage level Vout defined by equation (1), the output transistor 65 is turned off to cut the charge current. Thus, the penetrating current flowing from the high voltage source line VH to the low voltage source line VL through the output transistor 65 in the conventional drive circuit is removed, thereby reducing the power dissipation.

In the proposed drive circuit, the output node Vout is connected to the source of the output transistor 65. Accordingly, even if the gate voltage Vg is lowered in order to decrease the potential of the output node Vout, the potential of the output node Vout cannot be lowered in the case of relationship Vg−Vout<Vt due to the off state of the output transistor 65. That is, switch 68 must be closed to discharge the load 67 for lowering the potential of the output node to a low level VL at every horizontal period. The low level VL is lower than the lowest level applied to the liquid crystal, and the discharge of the output node Vout to this lower level VL again involves a significant power dissipation.

SUMMARY OF THE INVENTION

In view of the above, it is an object of the present invention to provide a drive circuit for a LCD device which is capable of reducing power dissipation, by further improving the proposed conventional drive circuit. It is another object of the present invention to provide a LCD device having such a drive circuit.

In one embodiment of the present invention, the present invention is directed to a drive circuit for driving an active matrix LCD panel, the drive circuit having an input terminal for receiving a video signal, and a plurality of drive sections corresponding to a number of data lines disposed in the LCD panel.

Each of the drive sections includes: an input node connected to the input terminal; an output node; first and second sample/hold circuits each for sampling a portion of the video signal through the input node during a horizontal scanning period and having an output for delivering the sampled signal portion therethrough; an nMOS transistor having a gate connected to the output of the first sample/hold circuit, a drain connected to a high voltage source line and a source; a first switch connected between the source of the nMOS transistor and the output terminal; a pMOS transistor having a gate connected to the output of the second sample/hold circuit, a drain connected to a low voltage source line and a source; and a second switch connected between the source of the pMOS transistor and the output terminal.

In accordance with the present invention, the proposed conventional drive circuit is further improved so that the first and second switches makes it unnecessary to reset the output node to a level lower than the lowest level applied to the liquid crystal at every horizontal period, thereby reducing power dissipation in the drive circuit of the present invention.

PREFERRED EMBODIMENTS OF THE INVENTION

Figure 7:
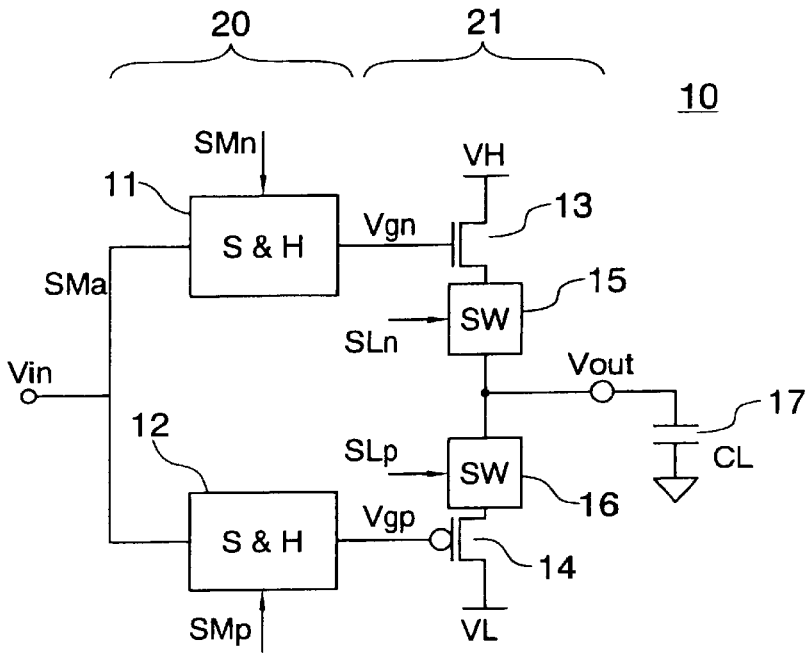
FIG. 7 is a block diagram of a drive section of a drive circuit for driving a LCD device according to an embodiment of he present invention.

Referring to FIG. 7, there is shown a drive section 10 of a data driver in a LCD drive circuit according to an embodiment of the present invention, wherein the drive section 10 corresponding to a single data line 17 includes a combination of a sample/hold block 20 and an output circuit 21.

The output circuit 21 is implemented by a source follower. The output circuit 21 includes an nMOS transistor 13 having a drain (drain electrode) connected to a high-potential source line VH, a pMOS transistor 14 having a drain connected to a low-potential source line VL, and a pair of switches 15 and 16 serially connected between the source (source electrode) of the nMOS transistor 13 and the source of the pMOS transistor 14. The node connecting both the sources of the nMOS transistor 13 and the pMOS transistor 14 together constitutes the output node Vout of the drive section 10 connected to a single data line denoted by numeral 17 as a load capacitor for the drive section 10.

The sample/hold block 20 for the single data line 17 includes a pair of sample/hold circuits 11 and 12. The first sample/hold circuit 11 operates for sampling during an odd-numbered horizontal scanning period, for example, of a specific frame period, and receives a portion of the input video signal to deliver the same to the gate of the nMOS transistor 13 as an output signal Vgn by responding to control signal SMn. The second sample/hold circuit 12 operates for sampling during an even-numbered horizontal scanning period, for example, of the specific frame period and receives a video signal portion to deliver the same to the gate of the pMOS transistor 14 as an output signal Vgp by responding to control signal SMp.

Figure 1:
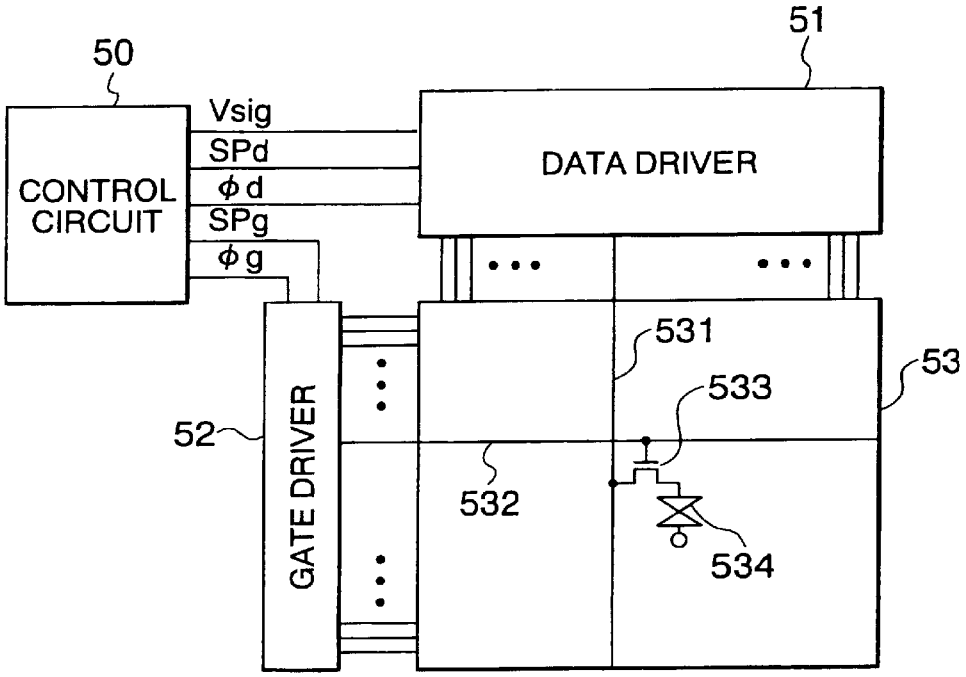
FIG. 1 PRIOR ART
FIG. 1 is a block diagram of a conventional LCD device.
Figure 2:
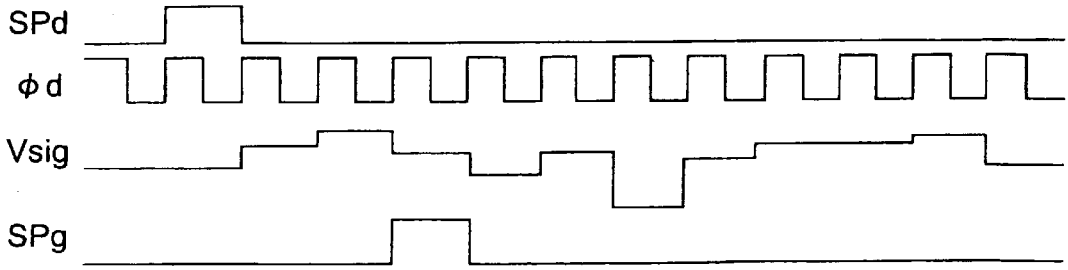
FIG. 2 PRIOR ART
FIG. 2 is a signal timing chart in the LCD device of FIG. 1.
Figure 3:
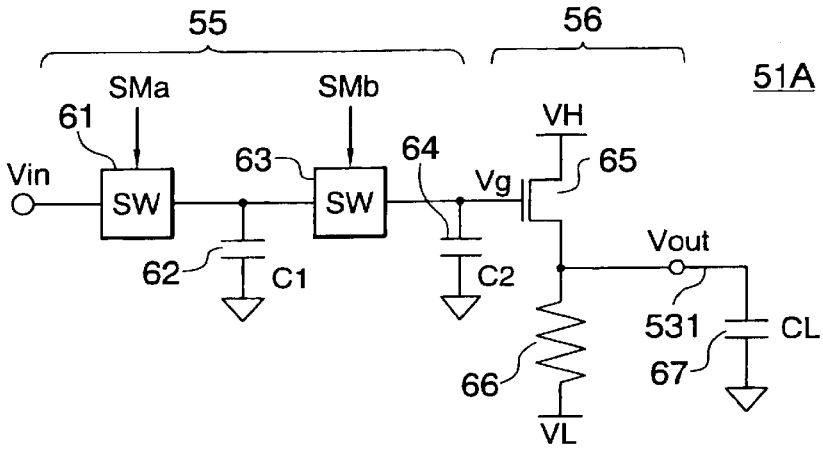
FIG. 3 PRIOR ART
FIG. 3 is an exemplified block diagram of a drive section of the driver circuit shown in FIG. 1.
Figure 4:
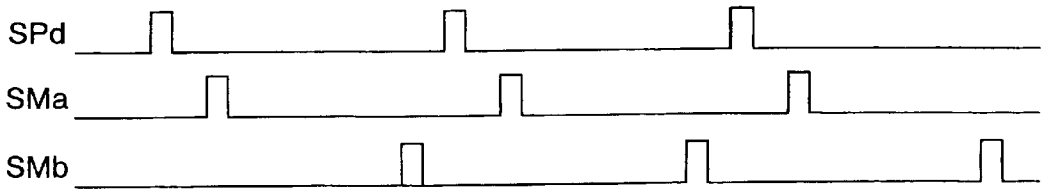
FIG. 4 PRIOR ART
FIG. 4 is a signal timing chart in the drive section of FIG. 3.
Figure 5:
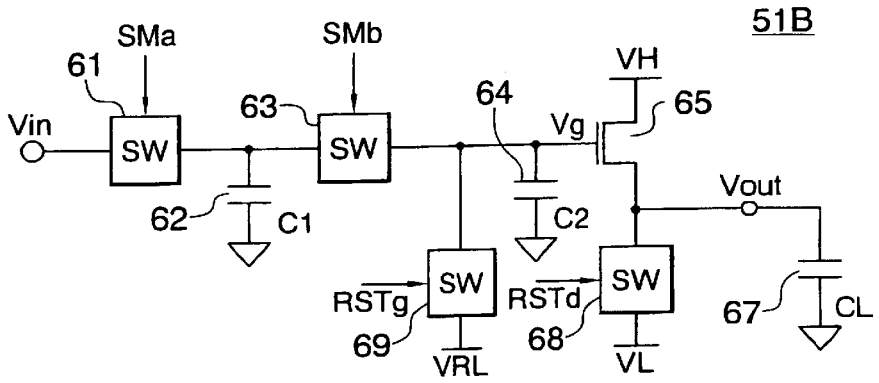
FIG. 5 PRIOR ART
FIG. 5 is a block diagram of an improved conventional drive section.
Figure 6:
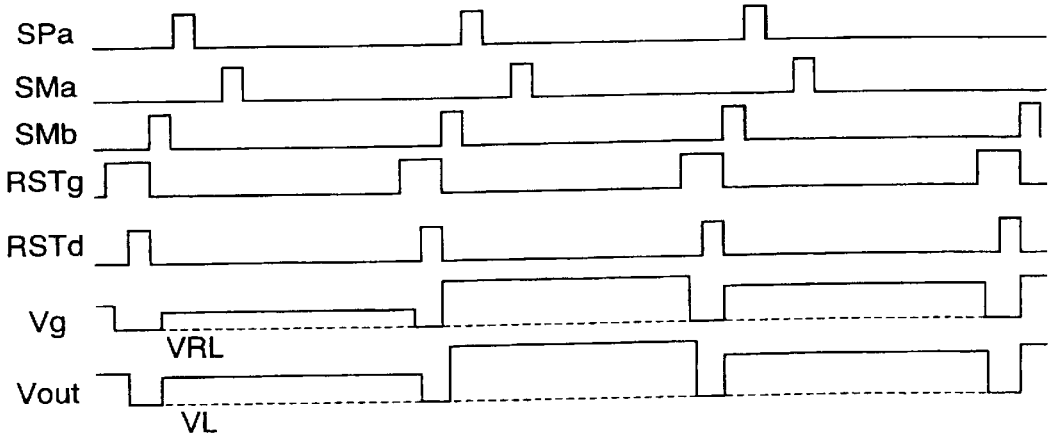
FIG. 6 PRIOR ART
FIG. 6 is a signal timing chart in the improved drive section of FIG. 5.

The input node Vin of the drive section 10 is connected to the input terminal of the data driver, which is connected to a video signal line for transmitting the video signal Vsig supplied from a control circuit (50 such as shown in FIG. 1). The data line 17 connected to the output node Vout of the drive section 10 has a relatively large parasitic capacitance, and the resistance component of the data line 17 can be substantially neglected. The load capacitance CL is in fact a sum of the parasitic capacitance of the data line 17 and the pixel capacitance.

Figure 8:
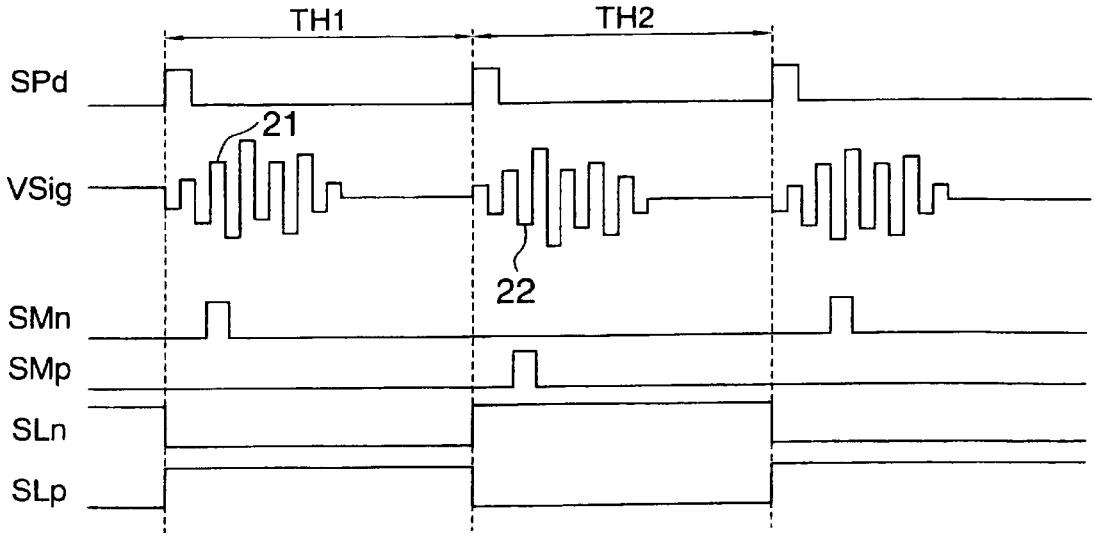
FIG. 8 is a signal timing chart in the drive section of FIG. 7.

Referring to FIG. 8, there is shown a signal timing chart in the drive section of FIG. 7. The drive circuit 10 of the present embodiment can be operated in either a dot inversion drive method or a data line inversion drive method both known in the art. Both the drive methods uses a video signal Vsig, the polarity of which alternates between adjacent horizontal scanning periods. Thus, the pixel elements connected to a single data line have alternating polarities with respect to a counter electrode. The counter electrode is known in the art which is common to all the pixel elements and constitutes one of the electrodes of each pixel element opposing to the pixel electrode of the each pixel element.

In the dot inversion drive method, the drive voltages applied to the pixel electrodes are such that the polarities of the adjacent two pixel electrodes, which are disposed adjacent to each other in either column or row direction, with respect to the counter electrode are opposite to each other. In other words, the polarities of the pixel electrodes with respect to the counter electrodes alternate as viewed along both the column direction and the row direction at each instance.

In the gate line inversion drive method, the drive voltages applied to the pixel electrodes are such that the polarities of a group of the pixel electrodes connected to a single gate line with respect to the counter electrode are same among the group, and opposite to the polarities of another group connected to an adjacent gate line. In the following description, a signal portion of the video signal Vsig which provides a positive polarity to the pixel electrode with respect to the counter electrode is referred to as a positive signal or a positive signal portion, whereas a signal portion which provides a negative polarity to the pixel electrode with respect to the counter electrode is referred to as a negative signal or a negative signal portion. FIG. 8 exemplarily shows a signal waveform used in the dot inversion drive method.

In both the drive methods as described above, the polarity of the video signal Vsig supplied to the drive circuit changes alternately between adjacent horizontal scanning periods TH1 and TH2. It is assumed that the signal portion 21 of the video signal Vsig to be sampled by the specific drive section of FIG. 7 during the specific horizontal scanning period TH1 has a positive polarity, as shown in FIG. 8. The first sample/hold circuit 11 for the nMOS transistor 13 samples the signal portion 21 of the video signal Vsig at this timing of the horizontal scanning period TH1 based on the scanning signal SMn supplied from the scanning circuit. In the horizontal scanning period TH1, the control signals SLn and SLp for controlling switches 15 and 16 are set at a low level and a high level, respectively, to open switch 15 and to close switch 16. Thus, the data line 17 connected to the output line Vout is driven by the pMOS transistor 14 based on the signal portion sampled during a previous horizontal period.

For the specific data line 17, a negative signal portion 22 of the video signal Vsig is then supplied during the next horizontal scanning period TH2. The second sample/hold circuit 12, by responding to the scanning signal SMp supplied from the scanning circuit, samples the negative signal portion 22. In the horizontal scanning period TH2, the control signals SLn and SLp are at a high level and a low level, respectively, to close switch 15 and to open switch 16. As a result, the data line 17 is driven by the nMOS transistor 13 based on the signal portion sampled during the previous horizontal scanning period TH1.

In the drive circuit of the present embodiment, either the nMOS transistor 13 or the pMOS transistor 14 alone cannot lower and raise the voltage of the data line 17 to a desired level, similarly to the proposed conventional drive circuit. However, the combination of switches 15 and 16 for operating alternately the nMOS transistor 13 and pMOS transistor 14 makes it unnecessary to reset the output node Vout to a specific voltage level, thereby reducing power dissipation involved in resetting the data line. In addition, by making the reset unnecessary, a larger time can be used for driving the data line 17 during a horizontal scanning period, which provides a higher throughput for writing of the video signal to the pixels to thereby improve the image quality of the LCD panel.

Figure 9:
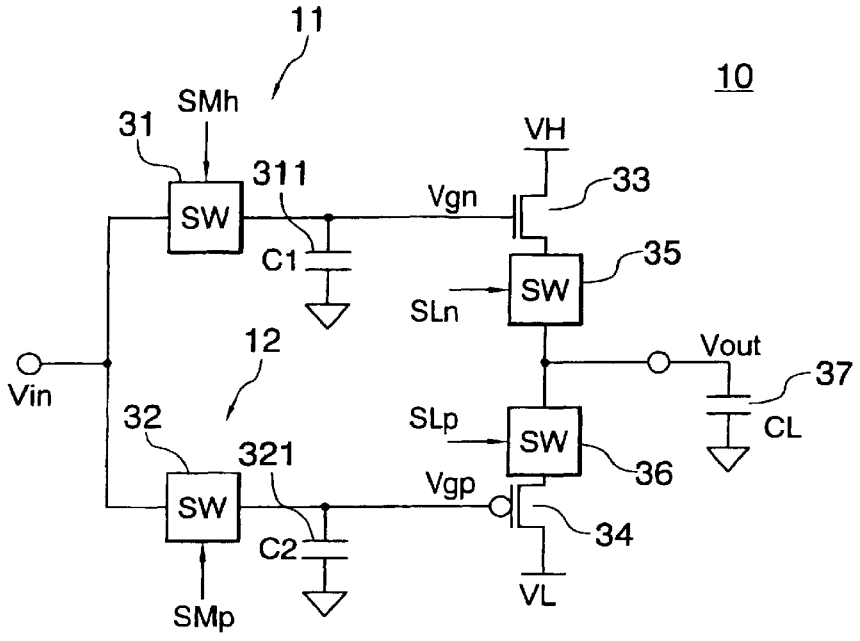
FIG. 9 is a block diagram of a practical example of the drive section of FIG. 7.

Referring to FIG. 9, there is shown a practical configuration of the drive section of FIG. 7. Each sample/hold circuit 11 or 12 in the sample/hold block 20 shown in FIG. 7 is implemented by a combination including a switch 31 or 32 and a storage capacitor 311 or 312 in FIG. 9. The output circuit is similar to the output circuit shown in FIG. 7.

Specifically, the output circuit includes an nMOS transistor 33 having a drain connected to a high-potential source line VH, a pMOS transistor 34 having a drain connected to a low-potential source line VL, and a pair of switches 35 and 36 serially connected between the source of the nMOS transistor 33 and the source of the pMOS transistor 34. The node connecting both the sources of the nMOS transistor 33 and the pMOS transistor 34 together constitutes the output node Vout of the drive section connected to the data line 37.

The sample/hold block includes a first sample/hold circuit having a switch 31 connected between the input node Vin and the gate of the nMOS transistor 33 and a storage capacitor 311 connected between the gate of the nMOS transistor 35 and the ground, and a second sample/hold circuit having a switch 32 connected between the input terminal Vin and the gate of the pMOS transistor 34 and a capacitor 321 connected between the gate of the pMOS transistor 34 and the ground.

The drive circuit according to the present embodiment can be operated based on the timing chart of FIG. 8 to eliminate the penetrating current flowing through both the transistors 33 and 34. In addition, since the electric energy is used substantially only for charging and discharging the data line 17 to a desired level and not for resetting the data line to a lower level, power dissipation can be reduced. This is obtained partly by using alternately the first sample/hold circuit and the second sample/hold circuit during a single frame period.

Figure 10:
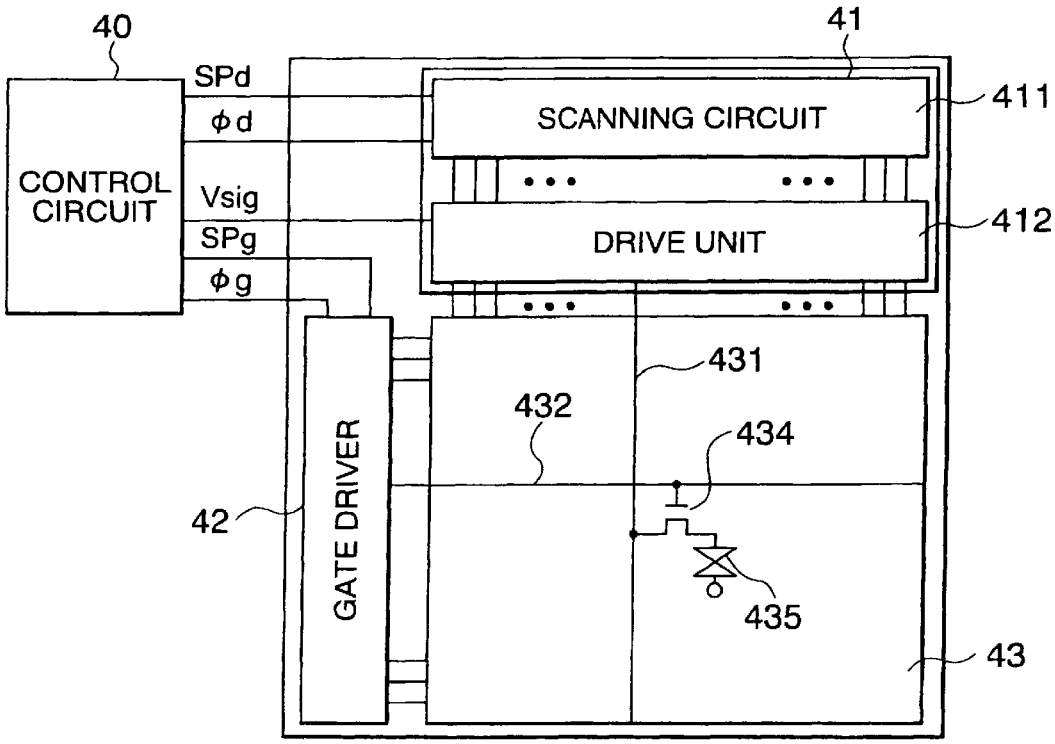
FIG. 10 is a block diagram of a LCD device according to an embodiment of the present invention.

Referring to FIG. 10, a LCD device according to an embodiment of the present invention is implemented by an active matrix LCD device formed on a single common substrate together with a pixel matrix 43.

The LCD device includes a plurality of data lines 431 extending parallel to one another in a column direction, a plurality of gate lines 432 extending parallel to one another in a row direction, and the pixel matrix 43 including a plurality of pixel elements arranged in a matrix and each disposed in the vicinity of cross points of the data lines 431 and the gate lines 432. Each pixel element includes therein a TFT 434 having a source connected to a corresponding data line 431 and a gate connected to a corresponding gate line 432, and a storage capacitor 435 connected between the drain of the corresponding TFT and the ground.

Each data line 431 and each gate line 432 are connected to a data driver 41 and a gate driver 42, respectively, of a drive circuit for the LCD device. The data driver 41 includes a scanning circuit 411 and an associated drive unit 412 having a plurality of drive sections such as described with reference to FIG. 7. The data driver 41 receive a video signal Vsig, starting pulse SPd and clock signal $\phi$d from a control circuit 40, whereas the gate driver 42 receives starting pulse SPg and clock signal $\phi$g from the control circuit 40, as in the case of the conventional drive circuit. The LCD device is driven by the control circuit 40 generally disposed outside the substrate of the LCD panel. The LCD device can operate in either a dot inversion drive method or a gate line inversion drive method.

In the present embodiment, a positive signal portion is delivered by the nMOS transistor whereas a negative signal portion is delivered by the pMOS transistor, which makes it unnecessary to reset the data line 17 every horizontal scanning period to reduce the power dissipation of the LCD device.

Since the above embodiments are described only for examples, the present invention is not limited to the above embodiments and various modifications or alterations can be easily made therefrom by those skilled in the art without departing from the scope of the present invention.

What is claimed is:

1. A drive circuit for driving an active matrix liquid crystal display (LCD) panel, said drive circuit comprising an input terminal for receiving a video signal, and a plurality of drive sections corresponding to a number of data lines disposed in the LCD panel, Each of said drive sections including: an input node connected to said input terminal; an output node; first and second sample/hold circuits each for sampling a portion of said video signal through said input node during a horizontal scanning period and having an output for delivering the sampled signal portion therethrough; a first transistor having a control electrode connected to the output of said first sample/hold circuit, a first electrode connected to a high voltage source line and a second electrode; a first switch connected between the second electrode of said first transistor and said output node; a second transistor having a control electrode connected to the output of said second sample/hold circuit, a first electrode connected to a low voltage source line and a second electrode; and a second switch connected between the second electrode of said second transistor and said output node.

2. The drive circuit as defined in claim 1, wherein said first and second sample/hold circuits operate for sampling during alternate horizontal scanning periods, said first switch is ON at a horizontal scanning period when said first sample/hold circuit does not operate for sampling, and said second switch is ON at a next horizontal scanning period when said second sample/hold circuit does not operate for sampling.

3. The drive circuit as defined in claim 1, wherein said first sample/hold circuit samples a positive signal portion of said video signal and said second sample/hold circuit samples a negative signal portion of said video signal.

4. The drive circuit as defined in claim 1, wherein said first transistor is an nMOS transistor, and said second transistor is a pMOS transistor.

5. The drive circuit as defined in claim 1, further comprising a horizontal scanning circuit for consecutively selecting said drive sections for sampling.

6. The drive circuit as defined in claim 5, wherein said horizontal scanning circuit alternately selects said first and second sample/hold circuits in each of said drive sections.

7. A liquid crystal display (LCD) device comprising a LCD matrix on a substrate, said LCD matrix including a plurality of pixel elements arranged in a matrix, a plurality of data lines extending in parallel in a column direction of said LCD matrix, a plurality of gate lines extending in parallel in a row direction of said LCD matrix, a data driver for driving said data lines, and a gate driver for driving said gate lines, said data driver including an input terminal for receiving a video signal, and a plurality of drive sections corresponding to said data lines, each of said drive sections including an input node connected to said input terminal, an output node, first and second sample/hold circuits each for sampling a corresponding portion of said video signal through said input node during a horizontal scanning period and an output for delivering the sampled signal portion therethrough, an nMOS transistor having a gate connected to the output of said first sample/hold circuit, a drain connected to a high voltage source line and a source, a first switch connected between the source of said nMOS transistor and said output node, a pMOS transistor having a gate connected to the output of said second sample/hold circuit, a drain connected to a low voltage source line and a source, and a second switch connected between the source of said pMOS transistor and said output node.

8. The LCD device as defined in claim 7, wherein said data driver includes a scanning circuit for generating a plurality of scanning signals for controlling said first and second sample/hold circuits of said drive sections.

* * * * *